US008414100B2

(12) United States Patent
Watanabe

(10) Patent No.: US 8,414,100 B2
(45) Date of Patent: Apr. 9, 2013

(54) LIQUID EJECTING HEAD INSPECTION APPARATUS, LIQUID EJECTING APPARATUS, AND INSPECTION METHOD OF LIQUID EJECTING HEAD INSPECTION APPARATUS

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 403 days.

(21) Appl. No.: 12/786,114

(22) Filed: May 24, 2010

(65) Prior Publication Data

US 2010/0302295 A1 Dec. 2, 2010

(30) Foreign Application Priority Data

May 29, 2009 (JP) ..... 2009-130085

(51) Int. Cl.
*B41J 29/393* (2006.01)

(52) U.S. Cl. ..... 347/19
(58) Field of Classification Search ..... None
See application file for complete search history.

(56) References Cited

U.S. PATENT DOCUMENTS

2008/0218554 A1 9/2008 Inoue

FOREIGN PATENT DOCUMENTS

| | | |
|---|---|---|
| JP | 59-093357 | 5/1984 |
| JP | 2006-212875 | 8/2006 |
| JP | 2007-038566 | 2/2007 |
| JP | 2008-221534 | 9/2008 |

OTHER PUBLICATIONS

Derwent document for JP 2006-212875 A. (JP doc was published Aug. 17, 2006).*
Machine translation of JP 2006-212875 A.*
Human translation of paragraphs 24-26 of JP 2006-212875 A.*

* cited by examiner

*Primary Examiner* — Lamson Nguyen
*Assistant Examiner* — Justin Seo
(74) *Attorney, Agent, or Firm* — Workman Nydegger

(57) ABSTRACT

A liquid ejecting head inspection apparatus detects malfunction of a liquid ejecting head that discharges liquid droplets. The liquid ejecting head inspection apparatus includes a liquid droplet landing portion on which a discharged liquid droplet can land. An electric change detecting unit detects an electric change in the liquid droplet landing portion. A controlling unit supplies a discharging drive signal to a driving element for discharging a liquid droplet, generates a potential difference between the discharged liquid droplet and the liquid droplet landing portion, and detects landing of the liquid droplet based on activity of the electric change detecting unit. A non-landing unit ensures that no liquid droplet lands on the liquid droplet landing portion when the discharging drive signal is applied to the driving element. A judging unit judges whether the liquid ejecting head inspection apparatus functions properly based on activity of the electric change detecting unit.

9 Claims, 11 Drawing Sheets

LIQUID EJECTING HEAD INSPECTION APPARATUS, LIQUID EJECTING APPARATUS, AND INSPECTION METHOD OF LIQUID EJECTING HEAD INSPECTION APPARATUS

BACKGROUND

1. Technical Field

The present invention relates to a liquid ejecting head inspection apparatus for inspecting the discharging of liquid droplets from a liquid ejecting head, which is a head that can eject liquid. In addition, the invention relates to a liquid ejecting apparatus and an inspection method of a liquid ejecting head inspection apparatus.

2. Related Art

An ink-jet recording apparatus such as an ink-jet printer, a plotter, or the like is provided with an ink-jet recording head. The ink-jet recording head discharges ink retained in an ink container such as an ink cartridge, an ink tank, or the like in the form of ink droplets.

An ink-jet recording head has a plurality of pressure generation chambers each of which is in communication with the corresponding one of a plurality of nozzle holes, a reservoir (manifold) that is in communication with the plurality of pressure generation chambers and functions as a common liquid chamber, and a plurality of pressure generation elements (pressure generating means) each of which generates a pressure change inside the corresponding pressure generation chamber to discharge a liquid droplet from the corresponding nozzle hole. Examples of the pressure generating means mounted in an ink-jet recording head are: longitudinal vibration type piezoelectric elements, deflection vibration type piezoelectric elements, electrostatic actuator devices, heating elements, or the like.

In order to guarantee predetermined print quality, an ink-jet recording apparatus that is provided with an ink-jet recording head performs missing-dot detection operation (discharging inspection/non-discharging inspection) at predetermined timing before printing. Various methods for missing-dot detection have been proposed. For example, the following missing-dot detection method has been proposed in the art. A voltage is applied between a nozzle plate (nozzle holes) and an inspection region that includes a liquid absorber so as to charge ink electrically. The electrically charged ink is ejected. A potential signal that represents a change in potential (i.e., voltage level) between the inspection area and the nozzle plate is outputted as a result of the discharging (i.e., ejecting) of the electrically charged ink. On the basis of the amplitude of the potential signal, missing dot detection can be performed. The above missing-dot detection method is disclosed in JP-A-2007-38566. The proposed missing-dot detection method utilizes a difference between the amplitude of a potential signal outputted when the charged ink is properly discharged and the amplitude of a potential signal outputted when the charged ink is not properly discharged.

A change in a potential signal (amplitude) obtained from an ink droplet is very small. For this reason, it is necessary to amplify a change in a potential signal in order to successfully detect the change in the potential signal attributable to the charged ink droplet. Because of the effects of noise on a discharging drive signal, in some cases, a change in a potential signal that is the same as that under proper ink-droplet discharging conditions, that is, conditions under which ink droplets are discharged properly, is mistakenly detected even when it should not be detected because no ink droplet is actually discharged or because ink droplets are not discharged fully. Such erroneous detection makes it impossible to conduct inspection accurately.

The problem identified above is not unique to an ink-jet recording head inspection apparatus. That is, the same problem could also arise in various kinds of liquid ejecting head inspection apparatuses.

SUMMARY

An advantage of some aspects of the invention is to provide a liquid ejecting head inspection apparatus, a liquid ejecting apparatus, and an inspection method of a liquid ejecting head inspection apparatus that makes it possible to check whether the liquid ejecting head inspection apparatus itself, which inspects whether a liquid droplet is properly discharged or not, is functioning properly or not, thereby detecting the presence/absence of an ink droplet discharged accurately.

In order to address the above-identified problem without any limitation thereto, a liquid ejecting head inspection apparatus for detecting malfunction of a liquid ejecting head that discharges a liquid droplet from a nozzle opening as a result of driving operation of a driving element is provided. A liquid ejecting head inspection apparatus according to a first aspect of the invention includes: a liquid droplet landing portion on or into which a liquid droplet discharged by the liquid ejecting head can land; an electric change detecting section that detects an electric change in the liquid droplet landing portion; a controlling section that performs control to supply a discharging drive signal for discharging a liquid droplet to the driving element, to generate a potential difference between the liquid droplet discharged by the liquid ejecting head and the liquid droplet landing portion, and to detect landing of the liquid droplet on the basis of a result of detection of the electric change detecting section when the electrically charged liquid droplet is ejected toward the liquid droplet landing portion in a state in which the potential difference is generated between the liquid droplet discharged by the liquid ejecting head and the liquid droplet landing portion; a non-landing section that ensures that no liquid droplet lands on or into the liquid droplet landing portion when the discharging drive signal is applied to the driving element; and a judging section that judges whether the liquid ejecting head inspection apparatus itself is functioning properly or not on the basis of the result of detection of the electric change detecting section. The non-landing section ensures that no liquid droplet lands on or into the liquid droplet landing portion when the discharging drive signal is applied to the driving element of the liquid ejecting head. With such a configuration, it is possible to check the effects of noise due to the application of a discharging drive signal on the basis of the result of detection of the electric change detecting section. By this means, it is possible to test whether the liquid ejecting head inspection apparatus is functioning properly or not, for example, in an erroneous detection state or not. Therefore, the liquid ejecting head inspection apparatus can conduct liquid droplet discharge inspection accurately.

In the configuration of a liquid ejecting head inspection apparatus according to the first aspect of the invention, it is preferable that the non-landing section should be a non-discharging section that ensures that no liquid droplet is discharged from the nozzle opening even when the driving element is driven by means of the discharging drive signal. With such a preferred configuration, it is possible to suppress the adverse effects of discharged liquid droplets turning into mist, and in addition, to reduce wasteful use of liquid, thereby reducing inspection cost.

In the preferred configuration of a liquid ejecting head inspection apparatus, it is further preferable that the non-discharging section should supply a destructing drive signal, which is a signal for disabling liquid ejection by destroying meniscus of liquid at the nozzle opening. With such a preferred configuration, it is possible to ensure that no liquid droplet lands on or into the liquid droplet landing portion by modifying a driving waveform without increasing the number of parts, which contributes to cost reduction.

In the preferred configuration of a liquid ejecting head inspection apparatus, the non-discharging section may include a cap member that can cap a liquid ejecting face through which the nozzle opening is formed, a suction device that is connected to the cap member, and a suction control unit that controls suction of the suction device and capping of the cap member so as to disable liquid ejection by destroying meniscus of liquid at the nozzle opening. With such a preferred configuration, it is possible to destroy meniscus easily and reliably by controlling the suction of the suction device and the capping of the cap member.

It is preferable that the liquid ejecting head inspection apparatus should further include a restoring section that restores meniscus after destruction at the nozzle opening. With such a preferred configuration, it is possible to restore meniscus after destruction to discharge liquid droplets properly.

In the preferred configuration of a liquid ejecting head inspection apparatus, the non-discharging section may include a liquid supplying section that supplies liquid to the liquid ejecting head and stops supplying of the liquid to the liquid ejecting head and further includes a liquid-supplying-section control section that performs control to stop the supplying of the liquid to the liquid ejecting head by the liquid supplying section. With such a preferred configuration, it is possible to ensure that no liquid droplet lands on or into the liquid droplet landing portion just by stopping the supply of liquid.

In the configuration of a liquid ejecting head inspection apparatus according to the first aspect of the invention, it is preferable that the controlling section should perform control to detect the landing of the liquid droplet on the basis of the result of detection of the electric change detecting section within a predetermined period of time after the discharging of the liquid droplet. With such a preferred configuration, it is possible to perform malfunction judgment processing accurately while suppressing or avoiding erroneous detection due to the effects of noise from the outside.

A liquid ejecting apparatus according to a second aspect of the invention is provided with a liquid ejecting head inspection apparatus according to the first aspect of the invention. Having such a configuration, a liquid ejecting apparatus according to the second aspect of the invention can conduct liquid droplet discharging/non-discharging inspection accurately.

As a third aspect of the invention, an inspection method of a liquid ejecting head inspection apparatus is provided. A liquid ejecting head discharges a liquid droplet from a nozzle opening as a result of driving operation of a driving element. The liquid droplet discharged by the liquid ejecting head from the nozzle opening lands on or into a liquid droplet landing portion. A potential difference is generated between the liquid droplet discharged from the nozzle opening and the liquid droplet landing portion. An electric change is detected when the liquid droplet lands on or into the liquid droplet landing portion. The landing of the liquid droplet on or into the liquid droplet landing portion is detected on the basis of electric change detection. The inspection method according to the third aspect of the invention includes: causing the driving element to perform driving operation for discharging the liquid droplet from the nozzle opening; and detecting the electric change in the liquid droplet landing portion while ensuring that no liquid droplet lands on or into the liquid droplet landing portion. The non-landing section ensures that no liquid droplet lands on or into the liquid droplet landing portion when the discharging drive signal is applied to the driving element of the liquid ejecting head. With such a method, it is possible to check the effects of noise due to the application of a discharging drive signal on the basis of the result of detection of the electric change detecting section. By this means, it is possible to test whether the liquid ejecting head inspection apparatus is functioning properly or not, for example, in an erroneous detection state or not. Therefore, the liquid ejecting head inspection apparatus can conduct liquid droplet discharge inspection accurately.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, exemplary embodiments of the present invention will now be explained in detail.

First Embodiment

Figure 1:
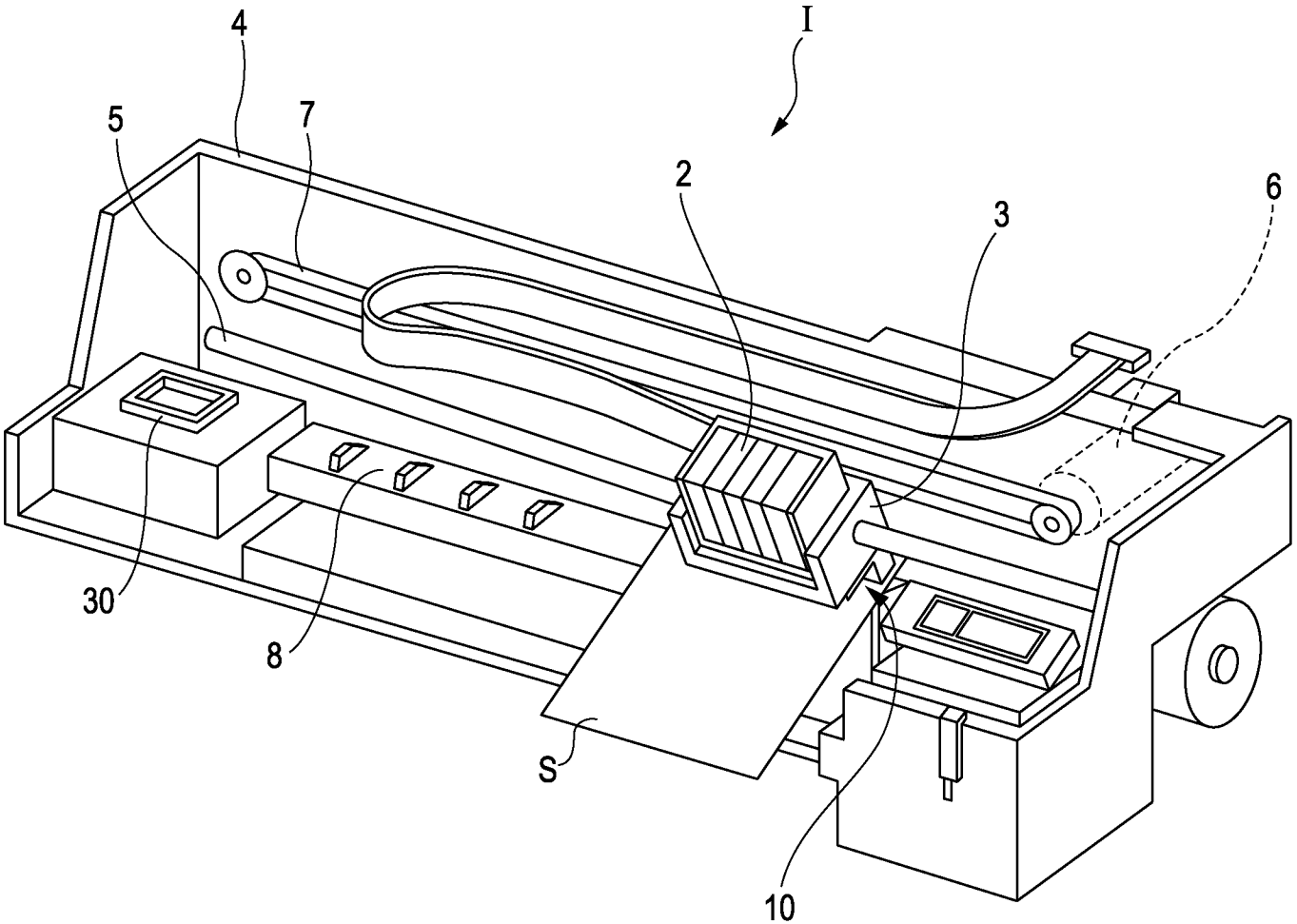
FIG. 1 is a perspective view that schematically illustrates an example of the configuration of a recording apparatus according to a first embodiment of the invention.

FIG. 1 is a perspective view that schematically illustrates an example of the configuration of an ink-jet recording apparatus, which is an example of various kinds of liquid ejecting apparatuses according to a first embodiment of the invention.

As illustrated in FIG. 1, an ink-jet recording apparatus I (an example of a liquid ejecting apparatus) is provided with an ink-jet recording head unit. Ink cartridges 2 are detachably attached to an ink-jet recording head 10. The ink cartridges 2 constitute an ink-supply unit. The ink-jet recording head 10 is mounted on a carriage 3. The carriage 3 is configured to move freely in the axial direction of a carriage shaft 5. The carriage shaft 5 is fixed to an apparatus body frame 4. The ink-jet recording head 10 is configured to discharge, for example, black ink compound and color ink compound.

The driving power of a driving motor 6 is transmitted to the carriage 3 through a plurality of gears, which is not illustrated in the drawing, and a timing belt 7. When the timing belt 7 turns, the carriage 3 on which the ink-jet recording head 10 is mounted travels along the carriage shaft 5. A platen 8 is provided inside the apparatus body frame 4 along the carriage shaft 5. A recording sheet S is transported over the platen 8. The recording sheet S, which is a recording target medium such as a sheet of paper or the like, is supplied onto the platen 8 by a paper-feed roller that is not shown in the drawing.

An area outside each edge of a printing area (i.e., two peripheral areas in the axial direction of the platen 8) is a non-printing area. A liquid droplet landing portion 30 of a liquid ejecting head inspection apparatus is provided in one of these two non-printing areas. A more detailed explanation of the liquid droplet landing portion 30 and the liquid ejecting head inspection apparatus will be given later.

Figure 2:
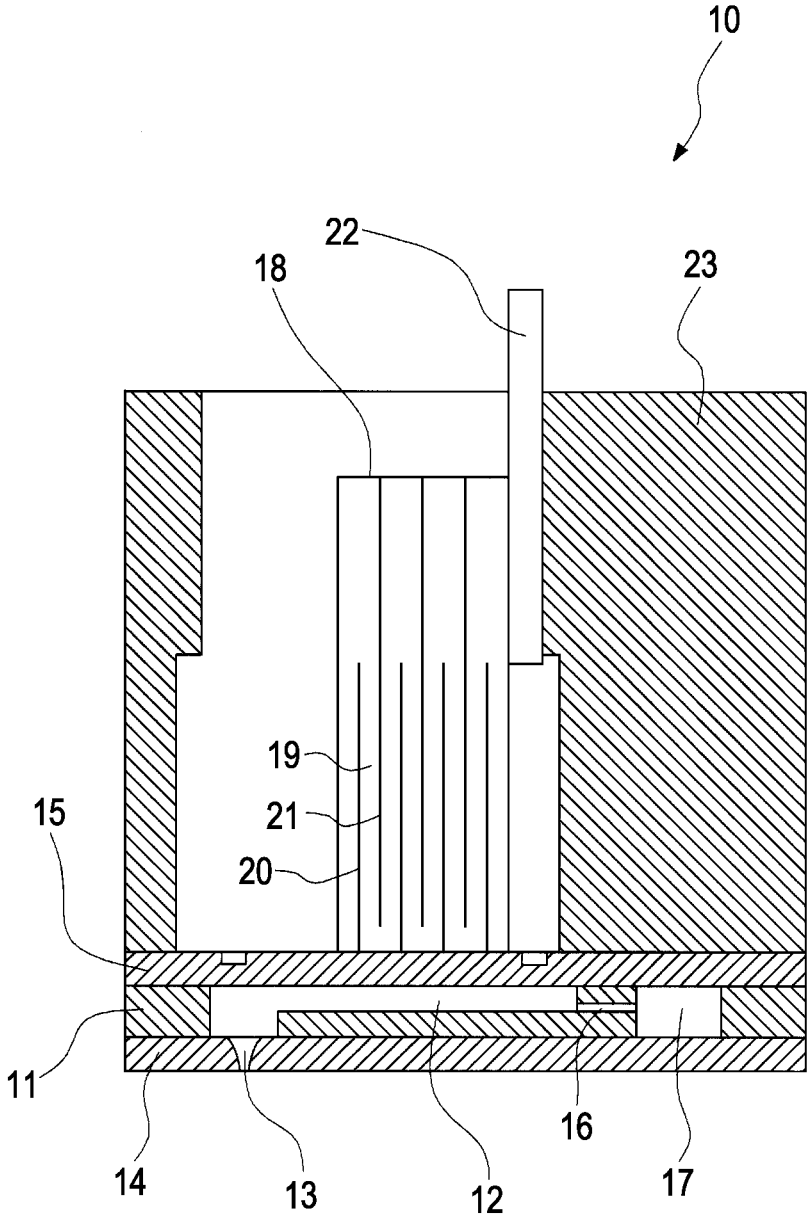
FIG. 2 is a sectional view that schematically illustrates an example of the configuration and structure of a recording head according to the first embodiment of the invention.

The configuration and structure of the ink-jet recording head 10 as a component of the ink-jet recording apparatus I is explained below. FIG. 2 is a sectional view that schematically illustrates an example of the configuration and structure of an ink-jet recording head, which is an example of various kinds of liquid ejecting heads according to the first embodiment of the invention.

The ink-jet recording head 10 illustrated in FIG. 2 is a head that is provided with longitudinal vibration type piezoelectric elements. A plurality of pressure generation chambers 12, which are pressure compartments, is formed in a fluid channel substrate 11 of the ink-jet recording head 10. The pressure generation chambers 12 are formed adjacent to one another. A nozzle plate 14 seals one surface of the fluid channel substrate 11. The nozzle plate 14 has a plurality of nozzle holes 13, which are openings each of which is formed for the corresponding one of the plurality of pressure generation chambers 12. A vibrating plate (e.g., diaphragm) 15 seals the other surface of the fluid channel substrate 11. In addition, a manifold 17 is formed in the fluid channel substrate 11. The manifold 17 is in communication with each of the plurality of pressure generation chambers 12 through an ink supply port 16. Accordingly, the manifold 17 functions as a common ink chamber that is shared by the pressure generation chambers 12. The ink cartridges 2 are in communication with the manifold 17.

One surface of the vibrating plate 15 defines a part of the wall of the pressure generation chambers 12. Piezoelectric elements 18 are provided in contact with the opposite surface of the vibrating plate 15. Specifically, the tip of each piezoelectric element 18 is in contact with the vibrating plate 15 at an area of the corresponding pressure generation chamber 12. These piezoelectric elements 18 have a layered structure. A piezoelectric material 19 and electrode formation materials 20 and 21 are vertically laminated one on another like a sandwich. The non-actuation portion of the piezoelectric element 18 is fixed to a fixing substrate 22. The non-actuation portion is a region that does not contribute to vibrating operation. The fixing substrate 22, the vibrating plate 15, the fluid channel substrate 11, and the nozzle plate 14 are fixed as a single member by means of a fixation base 23.

The ink-jet recording head 10 that has the above configuration and structure discharges ink droplets as follows. Ink is supplied from the ink cartridge 2 to the manifold 17 through an ink flow passage, which is in communication with the ink cartridge 2. The ink supplied to the manifold 17 is distributed to each pressure generation chamber 12 via the corresponding ink supply port 16. Specifically, a voltage is applied to the piezoelectric element 18 to cause the piezoelectric element 18 to contract. As a result of contraction, the vibrating plate 15 as well as the piezoelectric element 18 gets deformed to increase the capacity of the pressure generation chamber 12. In the illustrated example, the vibrating plate 15 is pulled upward. As the capacity of the pressure generation chamber 12 increases, ink is sucked into the pressure generation chamber 12. After the filling of ink in the pressure generation chamber 12 up to the nozzle hole 13, a voltage applied to the electrode formation materials 20 and 21 of the piezoelectric element 18 is released in response to a recording signal sent from a driving circuit. When it is released, the piezoelectric element 18 expands and returns to its original state. Therefore, the vibrating plate 15 also returns to its original state from an elastically displaced state. Since the vibrating plate 15 returns to the original non-deformed state, the capacity of the pressure generation chamber 12 decreases, which causes an increase in internal pressure. Due to the increased internal pressure, an ink droplet is discharged through the nozzle hole 13. That is, in the present embodiment of the invention, the longitudinal vibration type piezoelectric element 18 is provided as a driving element that causes a pressure change in the pressure generation chamber 12.

Figure 3:
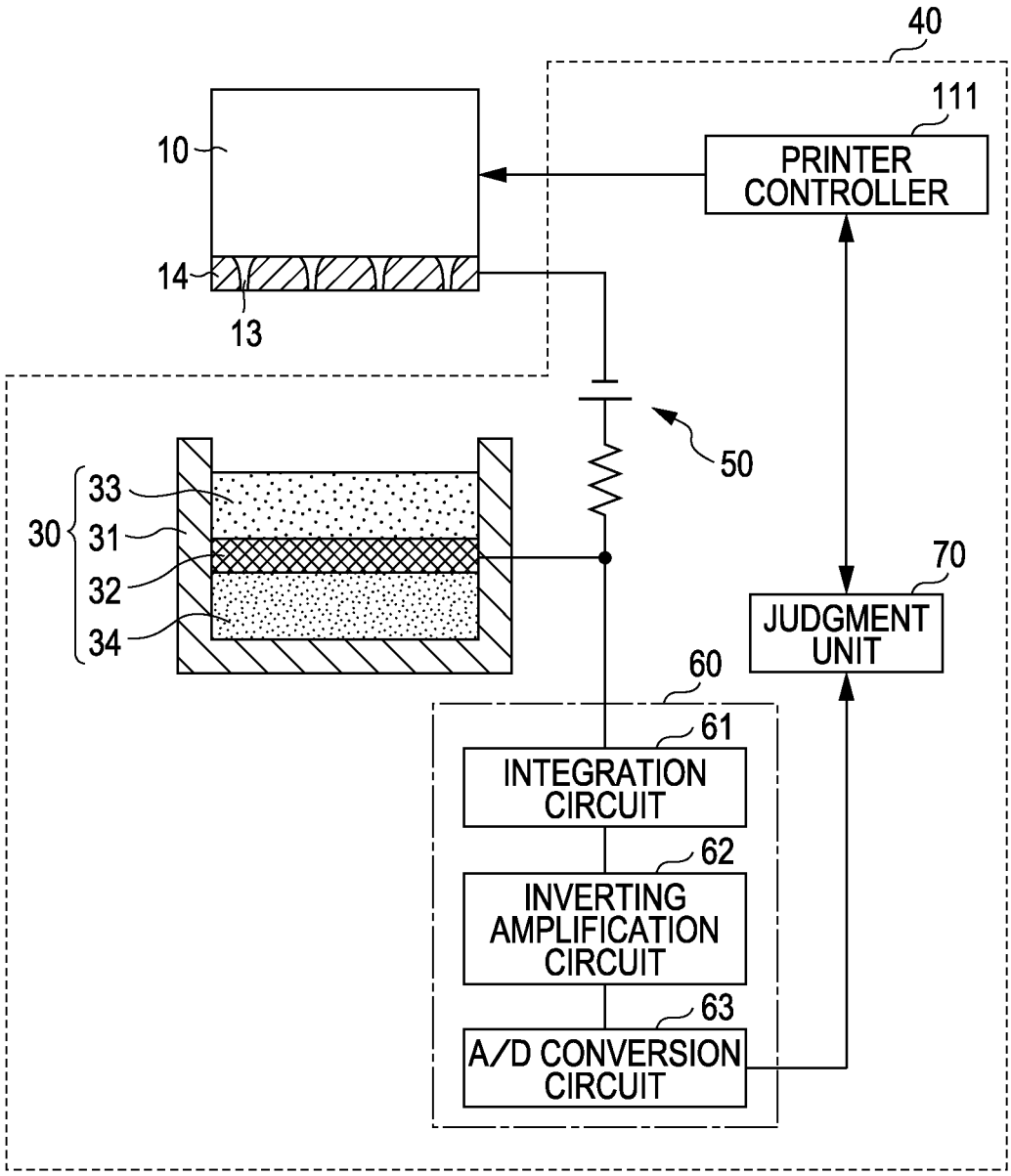
FIG. 3 is a diagram that schematically illustrates an example of the configuration of a liquid ejecting head inspection apparatus according to the first embodiment of the invention.

A liquid ejecting head inspection apparatus according to the present embodiment of the invention is explained below. FIG. 3 is a diagram that schematically illustrates an example of the configuration of a liquid ejecting head inspection apparatus according to the first embodiment of the invention.

A liquid ejecting head inspection apparatus 40 according to the present embodiment of the invention includes the liquid droplet landing portion 30, which is provided at a non-printing area of the ink-jet recording apparatus I (refer to FIG. 1).

As illustrated in FIG. 3, the liquid droplet landing portion 30 includes an inspection box 31, an electrode member 32, and two absorbing portions 33 and 34. The inspection box 31 is a catcher in which an ink droplet (liquid droplet) discharged from the nozzle hole 13 of the ink-jet recording head 10 can land. The electrode member 32 is a mesh member that is provided in the inspection box 31. The electrode member 32 has electrical conductivity. The electrode member 32 is sandwiched between the absorbing portions 33 and 34, which are made of absorber material provided in the inspection box 31.

An ink droplet discharged from the nozzle hole 13 of the ink-jet recording head 10 lands on the upper absorbing portion 33, which is provided on the electrode member 32 (i.e., at the side closer to the ink-jet recording head 10). The ink droplet (liquid droplet) that has landed on one (the upper) absorbing portion 33 permeates through the mesh electrode member 32. The other absorbing portion 34, which is provided under the electrode member 32, absorbs the ink (liquid).

For example, a conductive metal material that is woven into a lattice mesh can be used as the electrode member 32. A conductive material can be used as the material of the upper absorbing portion 33 provided on the electrode member 32. In particular, porous material such as sponge, non-woven fabric, or the like can be used for the upper absorbing portion 33. On the other hand, the lower absorbing portion 34, which is provided under the electrode member 32, may be made of either a conductive material or an insulating material. In particular, porous material such as sponge, non-woven fabric, or the like can be used for the lower absorbing portion 34.

A voltage application circuit 50 is connected to the electrode member 32. The voltage application circuit 50 is a circuit that generates a potential difference between an ink droplet discharged from the ink-jet recording head 10 and the electrode member 32. The voltage application circuit 50 is made up of a direct-current power supply (e.g., 400V) and a resistance element (e.g., 1 MΩ). One terminal of the voltage application circuit 50 is electrically connected to the electrode member 32. This terminal is a positive electrode. The other terminal of the voltage application circuit 50 is electrically connected to the ink-jet recording head 10. This terminal is a negative electrode. At the ink-jet-recording-head (10) side, a voltage is applied in such a way that an ink droplet discharged from the nozzle hole 13 of the ink-jet recording head 10 should have a predetermined polarity. The nozzle plate 14 through which the nozzle holes 13 are formed is made of a conductive material. Accordingly, in the present embodiment of the invention, the nozzle plate 14 is polarized into a predetermined polarity.

Since the electrode member 32 is in contact with the absorbing portion 33, which is provided on the electrode member 32 and has electrical conductivity, the voltage level (i.e., potential) of the electrode member 32 is the same as that of the surface of the upper absorbing portion 33 provided thereon.

A voltage detection circuit 60 is a circuit that functions as an electric change detecting section, which detects an electric change that occurs in the liquid droplet landing portion 30. The voltage detection circuit 60 includes an integration circuit 61, an inverting amplification circuit 62, and an analog-to-digital (A/D) conversion circuit 63. The integration circuit 61 integrates a voltage signal of the liquid droplet landing portion 30 (the electrode member 32) to output an integration result. The inverting amplification circuit 62 performs inverting amplification on the output signal of the integration circuit 61 to output an inverting amplification result. The A/D conversion circuit 63 performs A/D conversion on the output signal of the inverting amplification circuit 62 to output an A/D conversion result to a judgment unit 70.

A change in voltage that occurs as a result of the movement of a single droplet of ink in the air and its landing is very subtle. Therefore, the integration circuit 61 calculates an integrated value of the voltage change on the basis of the movement of plural droplets of ink in the air and the landing thereof, thereby outputting the integration result as a large voltage change.

The inverting amplification circuit 62 inverts the polarity (i.e., positive and negative) of the voltage change. In addition, the inverting amplification circuit 62 amplifies the signal outputted from the integration circuit 61 with a predetermined amplification factor and then outputs the amplified signal. The predetermined amplification factor is determined on the basis of its circuit configuration.

The A/D conversion circuit 63 converts the signal outputted from the inverting amplification circuit 62, which is an analog signal, into a digital signal and then outputs the digital signal to the judgment unit 70.

The judgment unit 70 judges whether the liquid ejecting head inspection apparatus 40 is in a malfunctioning state or not on the basis of the result of detection performed by the voltage detection circuit 60, which is an electric change detecting section according to an aspect of the invention. The judgment unit 70 is connected to a printer controller 111 besides the voltage detection circuit 60. The printer controller 111 controls the entire operation of the ink-jet recording apparatus I including the liquid ejecting head inspection apparatus 40. A more detailed explanation of fault inspection will be given later.

Figure 4:
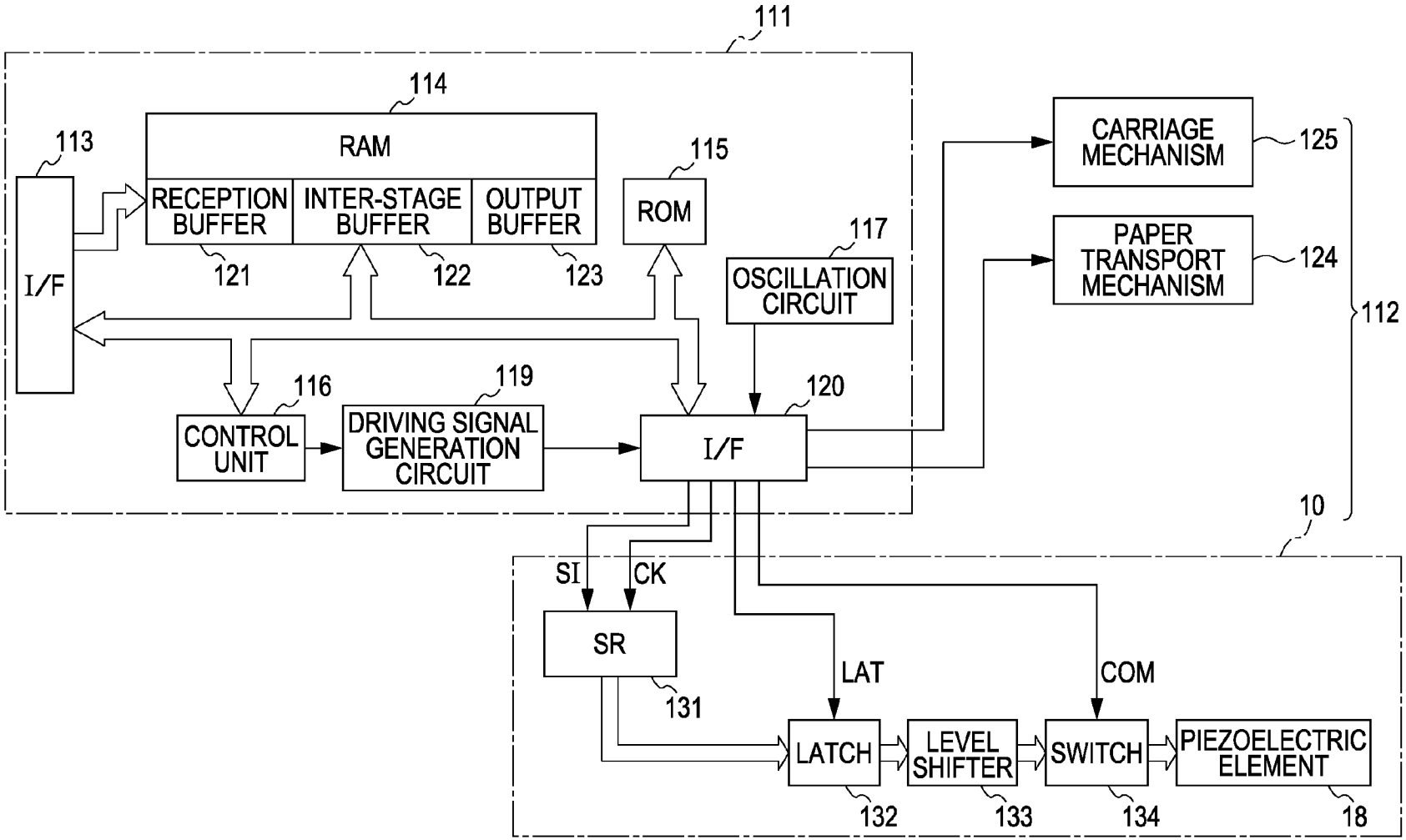
FIG. 4 is a block diagram that schematically illustrates an example of the control configuration of a recording apparatus according to the first embodiment of the invention.

The control configuration of the ink-jet recording apparatus I and the liquid ejecting head inspection apparatus 40 according to the present embodiment of the invention is explained below. FIG. 4 is a block diagram that schematically illustrates an example of the control configuration of an ink-jet recording apparatus and a liquid ejecting head inspection apparatus according to the present embodiment of the invention.

As illustrated in FIG. 4, the ink-jet recording apparatus I according to the present embodiment of the invention is mainly made up of the printer controller 111 and a print engine 112. The printer controller 111 includes an external interface (hereinafter partially abbreviated as "external I/F") 113, a RAM 114 that temporarily stores various kinds of data, a ROM 115 that stores control programs and the like, a control unit 116 that includes a CPU and the like, an oscillation circuit 117 that generates a clock signal, a driving signal generation circuit 119 that generates a driving signal that is supplied to the ink-jet recording head 10, and an internal interface (hereinafter partially abbreviated as "internal I/F") 120 through which a driving signal, dot pattern data (e.g., bitmap data) rendered on the basis of print data, and the like are transmitted to the print engine 112.

The external I/F 113 is an interface through which print data that includes, for example, character codes, graphic functions, image data, and the like is received from a host computer that is not illustrated in the drawing. In addition, a busy signal (BUSY) and an acknowledge signal (ACK) are outputted to the host computer through the external I/F 113. The RAM 114 functions as a reception buffer 121, an inter-stage buffer 122, an output buffer 123, and a work memory that is not illustrated in the drawing. The reception buffer 121 temporarily stores print data that has been received through the external I/F 113. The inter-stage buffer 122 stores intermediate code data converted by the control unit 116. The output buffer 123 stores dot pattern data. The dot pattern data is print data obtained by decoding (i.e., translating) gradation data (or grayscale data).

Besides control programs (control routines) that are used for performing various kinds of data processing, font data, graphic functions, and the like are stored in the ROM 115. The control unit 116 reads print data out of the reception buffer 121. In addition, the control unit 116 causes the inter-stage buffer 122 to memorize intermediate code data, which is obtained by converting the print data. Moreover, the control unit 116 analyses the intermediate code data read out of the inter-stage buffer 122. While referring to font data, graphic functions, and the like that are stored in the ROM 115, the control unit 116 renders (i.e., "expands") the intermediate code data into dot pattern data. The control unit 116 performs decoration processing according to need and thereafter causes the output buffer 123 to memorize the rendered dot pattern data.

Upon the acquisition of dot pattern data that corresponds to one line of the ink-jet recording head 10, the acquired dot pattern data for one line is outputted to the ink-jet recording head 10 through the internal I/F 120. In addition, upon the output of dot pattern data that corresponds to one line from the output buffer 123, the intermediate code data that has already been rendered is deleted from the inter-stage buffer 122. Then, rendering processing for the next intermediate code data is initiated.

The print engine 112 includes the ink-jet recording head 10, a paper transport mechanism 124, and a carriage mechanism 125. The paper transport mechanism 124 includes a paper-feed roller, a paper-feed motor that supplies driving power for rotating the paper-feed roller, the platen 8, and the like. The paper transport mechanism 124 feeds print target media such as plural sheets of recording paper in a sequential manner in synchronization with the recording operation of the ink-jet recording head 10. That is, the paper transport mechanism 124 moves print target media relative to the ink-jet recording head 10 in the sub scan direction.

The carriage mechanism 125 includes the carriage 3 on which the ink-jet recording head 10 is mounted and a carriage driving unit for moving the carriage 3 in the main scan direction. The ink-jet recording head 10 moves in the main scan direction as the carriage 3 travels together therewith. As explained earlier, the carriage driving unit includes the driving motor 6, the timing belt 7, and the like.

The ink-jet recording head 10 has the plurality of nozzle holes 13 along the sub scan direction. The ink-jet recording head 10 discharges ink droplets from the nozzle holes 13 according to timing specified by dot pattern data or the like. An electric signal such as a discharging drive signal (COM), which will be explained later, print data (S1), and the like are supplied to the piezoelectric elements 18 of the ink-jet recording head 10 through external wiring, which is not illustrated in the drawing. In the configuration of the printer controller 111 and the print engine 112, a driving circuit that is not illustrated in the drawing and the printer controller 111 function in combination as a driving means for applying a predetermined driving signal to the piezoelectric elements 18. The driving circuit includes latches 132, level shifters 133, switches 134, and the like. The latches 132 apply the predetermined driving signal, which has a predetermined driving waveform, selectively to the piezoelectric elements 18. The driving signal generation circuit 119 outputs the predetermined driving signal to the latches 132.

A shift register (SR) 131, the latch 132, the level shifter 133, the switch 134, and the piezoelectric element 18 are provided for each of the plurality of nozzle holes 13 of the ink-jet recording head 10. The shift register 131, the latch 132, the level shifter 133, and the switch 134 generate a driving pulse from a discharging drive signal or a destructing drive signal, which is generated by the driving signal generation circuit 119. The driving pulse is a pulse that is applied to the piezoelectric element 18.

In synchronization with a clock signal (CK) outputted from the oscillation circuit 117, print data (S1) that constitute dot pattern data are transferred serially from the output buffer 123 to the shift registers 131 of the ink-jet recording head 10. The data transferred serially are sequentially set at the shift registers 131. Specifically, the highest-order bit in the print data for all of the nozzle holes 13 are transferred serially first. Then, after completion of serial transfer of the highest-order bit data, the second highest-order bit data are transferred serially. Thereafter, data of lower bits are transferred sequentially and serially.

When the bit in the print data for each of the nozzle holes 13 has been set at the corresponding shift register 131, the control unit 116 performs control for outputting a latch signal (LAT) to the latch 132 at predetermined timing. Upon receiving the latch signal, the latch 132 latches the print data set at the shift register 131. The print data (LATout) latched by the latch 132 is applied to the level shifter 133, which is a voltage amplifier. For example, in a case where the print data is "1", the level shifter 133 boosts the print data up to a voltage value that is high enough to drive the switch 134. It is raised to, for example, tens of volts. The boosted print data is supplied to each switch 134. As a result of the application of the boosted data, the switch 134 is brought into a connected state.

Besides the boosted data supplied from the level shifter 133, a driving signal (COM) generated by the driving signal generation circuit 119 is supplied to each switch 134. When a switch 134 is selectively brought into a connected state, the driving signal is selectively applied to the corresponding piezoelectric element 18, which is connected to this switch 134. As explained above, in the operation of the ink-jet recording head 10 according to the present embodiment of the invention, it is possible to control whether a discharging drive signal should be applied to the piezoelectric element 18 or not on the basis of print data. For example, since the switch 134 is set in a connected state by a latch signal (LAT) during a time period in which print data is "1", it is possible to supply a driving signal (COMout) to the piezoelectric element 18. The piezoelectric element 18 becomes displaced (i.e., deformed) due to the driving signal (COMout) supplied thereto. On the other hand, the switch 134 is set in a disconnected state during a time period in which print data is "0". Therefore, the supply of a driving signal to the piezoelectric element 18 is cut off. Each piezoelectric element 18 retains the immediately preceding potential during the time period in which the print data is "0". Therefore, it keeps the immediately preceding deformation state.

As explained earlier, the piezoelectric element 18 is a longitudinal vibration type piezoelectric element. The vertical-vibration piezoelectric element 18 contracts in the vertical direction when it is charged. As the piezoelectric element 18 contracts, the pressure generation chamber 12 expands. The piezoelectric element 18 expands in the vertical direction when it is discharged. As the piezoelectric element 18 expands, the pressure generation chamber 12 contracts. The capacity of the pressure generation chamber 12 changes in accordance with the charging and discharging of the piezoelectric element 18. Utilizing a pressure change that occurs in the pressure generation chambers 12, the ink-jet recording head 10 can discharge ink droplets from the nozzle holes 13.

The control unit 116 controls the driving signal generation circuit 119 to supply a discharging drive signal for discharging an ink droplet from the nozzle hole 13 or a destructing drive signal for disabling ink ejection (liquid ejection) by collapsing (i.e., destroying) meniscus at the nozzle hole 13 to the ink-jet recording head 10.

Figure 5:
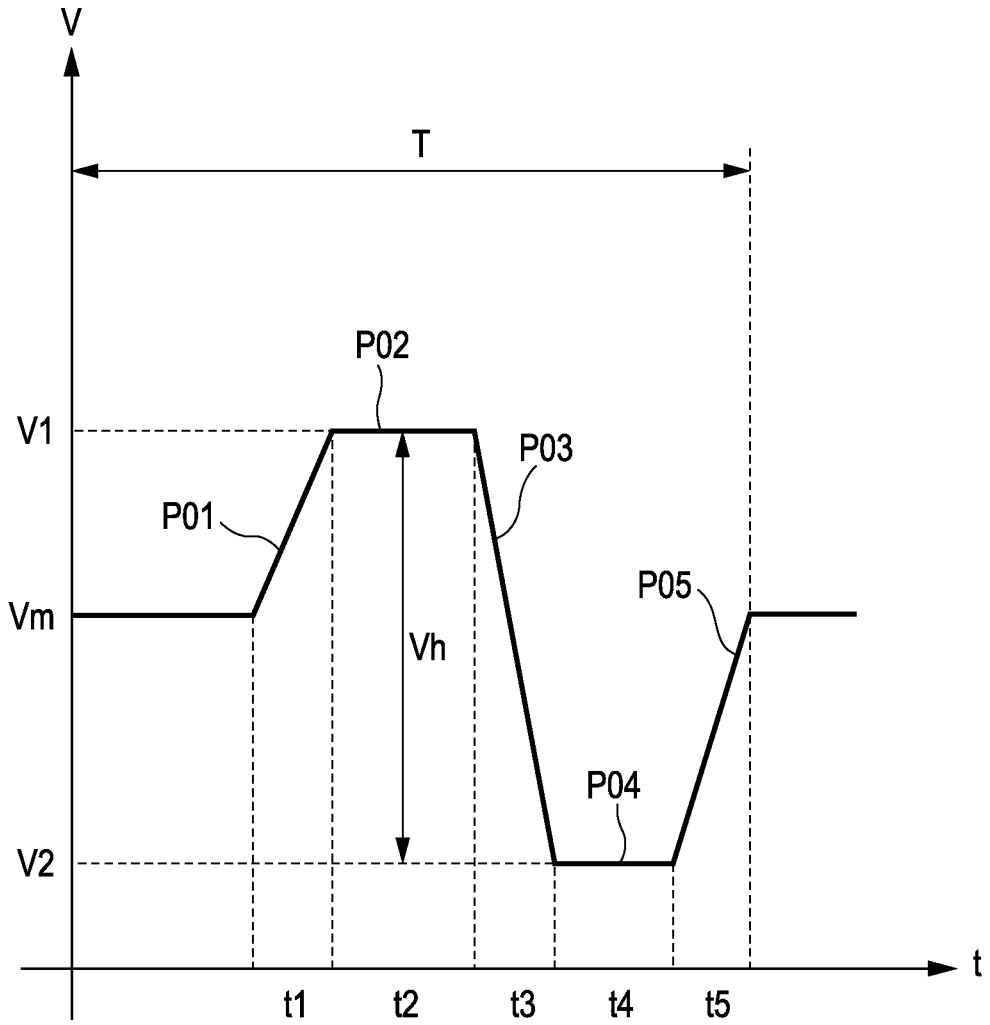
FIG. 5 is a diagram that schematically illustrates an example of the driving waveform of a discharging drive signal according to the first embodiment of the invention.

As illustrated in FIG. 5, a discharging drive signal is a signal that includes a discharging pulse in each recording period T. The pulse is generated repetitively for cycles of the recording period T. The discharging pulse is a pulse for driving the piezoelectric element 18, which is an example of a driving element according to an aspect of the invention, so as to discharge an ink droplet.

The discharging drive waveform of a discharging drive signal (COM) according to the present embodiment of the invention that is inputted into the piezoelectric element 18 is explained below. FIG. 5 is a diagram that schematically illustrates an example of the driving waveform of a discharging drive signal according to the present embodiment of the invention.

A discharging drive waveform (driving pulse) illustrated in FIG. 5 is made up of a first expansion "pulse element" (hereinafter simply referred to as "element") P01, a first hold element P02, a first contraction element P03, a second hold element P04, and a first vibration suppression element P05. The first expansion element P01 is, for example, a part of a pulse that raises the level of a voltage (i.e., potential) from a constant medium voltage level Vm to a first expansion voltage level V1 during a time period t1, thereby causing the pressure generation chamber 12 to expand. The first hold element P02 keeps the voltage level at the first expansion voltage level V1 throughout a time period t2. The first contraction element P03 lowers the voltage level from the first expansion voltage level V1 to a first contraction voltage level V2 sharply with a steep downward inclination during a time period t3, thereby causing the pressure generation chamber 12 to contract. The second hold element P04 keeps the voltage level at the first contraction voltage level V2 throughout a time period t4. The first vibration suppression element P05 raises the voltage level from the first contraction voltage level V2 back to the medium voltage level Vm with a certain upward inclination during a time period t5 to the extent that no ink droplet is discharged during this time period t5. A potential difference between the first expansion voltage level V1 and the first contraction voltage level V2 is denoted as Vh.

When a driving pulse that has the above discharging drive waveform is supplied to the piezoelectric element 18, the piezoelectric element 18 gets deformed in a direction for increasing the capacity of the pressure generation chamber 12 first due to the application of the first expansion element P01 thereto. Since the pressure generation chamber 12 expands, meniscus that is present in the nozzle hole 13 is sucked toward the pressure generation chamber 12. In addition, ink is supplied from the manifold 17 into the pressure generation chamber 12 due to the expansion of the pressure generation chamber 12. The first hold element P02 keeps such an expansion state of the pressure generation chamber 12. Thereafter, when the first contraction element P03 is applied to the piezoelectric element 18, the piezoelectric element 18 expands. Since the piezoelectric element 18 expands, the capacity of the pressure generation chamber 12 decreases sharply from expansion capacity, which corresponds to the first expansion voltage level V1, to contraction capacity, which corresponds to the first contraction voltage level V2. As a result, ink retained in the pressure generation chamber 12 is pressurized. An ink droplet is discharged from the nozzle hole 13 due to the increased internal pressure. The second hold element P04 keeps such a contraction state of the pressure generation chamber 12. During this time period in which the second hold element P04 is applied, ink pressure inside the pressure generation chamber 12 that decreased due to the discharging of an ink droplet in the immediately preceding time period increases again due to natural vibration. In synchronization with the increase in ink pressure, the first vibration suppression element P05 is applied to the piezoelectric element 18. Therefore, the capacity of the pressure generation chamber 12 returns to its standard capacity to damper pressure fluctuation inside the pressure generation chamber 12. As understood from the above description, a discharging drive pulse generated by a discharging drive signal according to the present embodiment of the invention is a push-pull type pulse.

On the other hand, a destructing drive signal is a signal that collapses meniscus of ink (liquid) formed at the nozzle hole 13 by driving the piezoelectric element 18, which is an example of a driving element, so that no ink droplet can be discharged from the nozzle hole 13. Such a destructing drive signal can be generated as a modified signal of a discharging drive signal. For example, it is possible to generate a destructing drive signal by arbitrarily modifying the voltage levels Vm, V1, and V2, the voltage level difference Vh, the voltage application time t1 to t5, the cycle T, and the like, of a discharging drive pulse illustrated in FIG. 4.

Figure 6A:
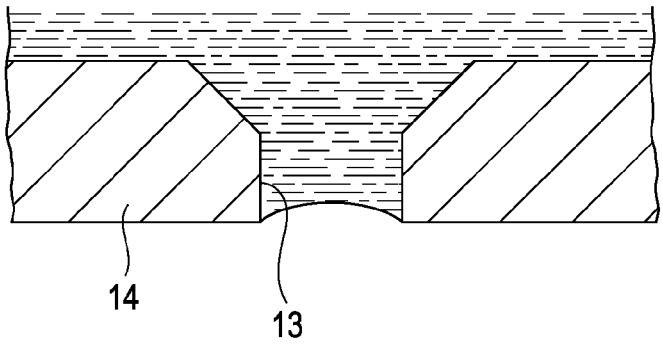
FIGS. 6A, 6B, and 6C are a set of sectional views that schematically illustrates an example of the state of meniscus according to the first embodiment of the invention.
Figure 6B:
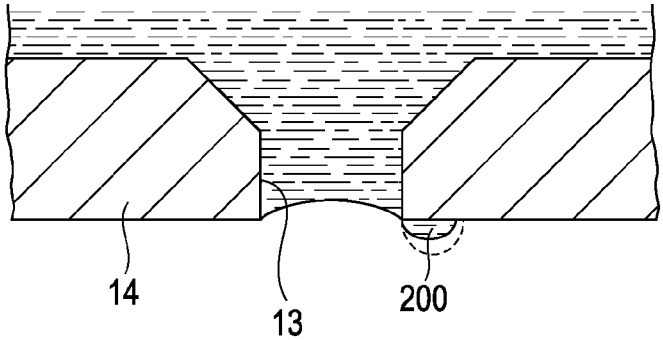
Figure 6C:
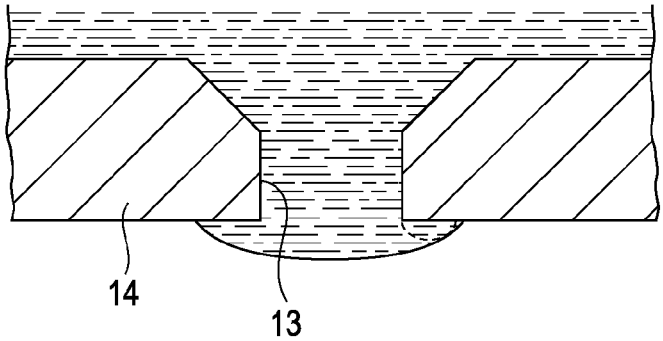

The normal state of meniscus at the nozzle hole 13 from which an ink droplet is discharged is illustrated in FIG. 6A. When the piezoelectric element 18 is driven by means of a destructing drive signal whose voltage levels Vm, V1, and V2, voltage level difference Vh, voltage application time t1 to t5, cycle T, and the like, are arbitrarily modified from those of a discharging drive signal, an ink-discharging direction deviates from its normal straight direction. Because of the directional deviation thereof, as illustrated in FIG. 6B, ink 200 sticks to a peripheral area of the nozzle hole 13. Since "discharging operation" is repeated with such directional deviation, the ink 200 that sticks to the peripheral area of the nozzle hole 13 grows. Finally, the ink 200 covers the nozzle hole 13 as illustrated in FIG. 6C. In a state in which the ink 200 covers the nozzle hole 13 as illustrated in FIG. 6C, no ink droplet will be actually discharged from the nozzle hole 13 even when the piezoelectric element 18 is driven by means of a discharging drive signal such as one that is illustrated in FIG. 5.

As explained above, in the present embodiment of the invention, the printer controller 111 functions as a "non-landing" section according to an aspect of the invention, which ensures that no liquid droplet (e.g., ink droplet) lands on or into the liquid droplet landing portion 30. In addition, in the present embodiment of the invention, the printer controller 111 functions as a "non-discharging" section according to an aspect of the invention, which ensures that no liquid droplet is discharged from the nozzle hole 13.

Figures 7A, 7B, 7C:
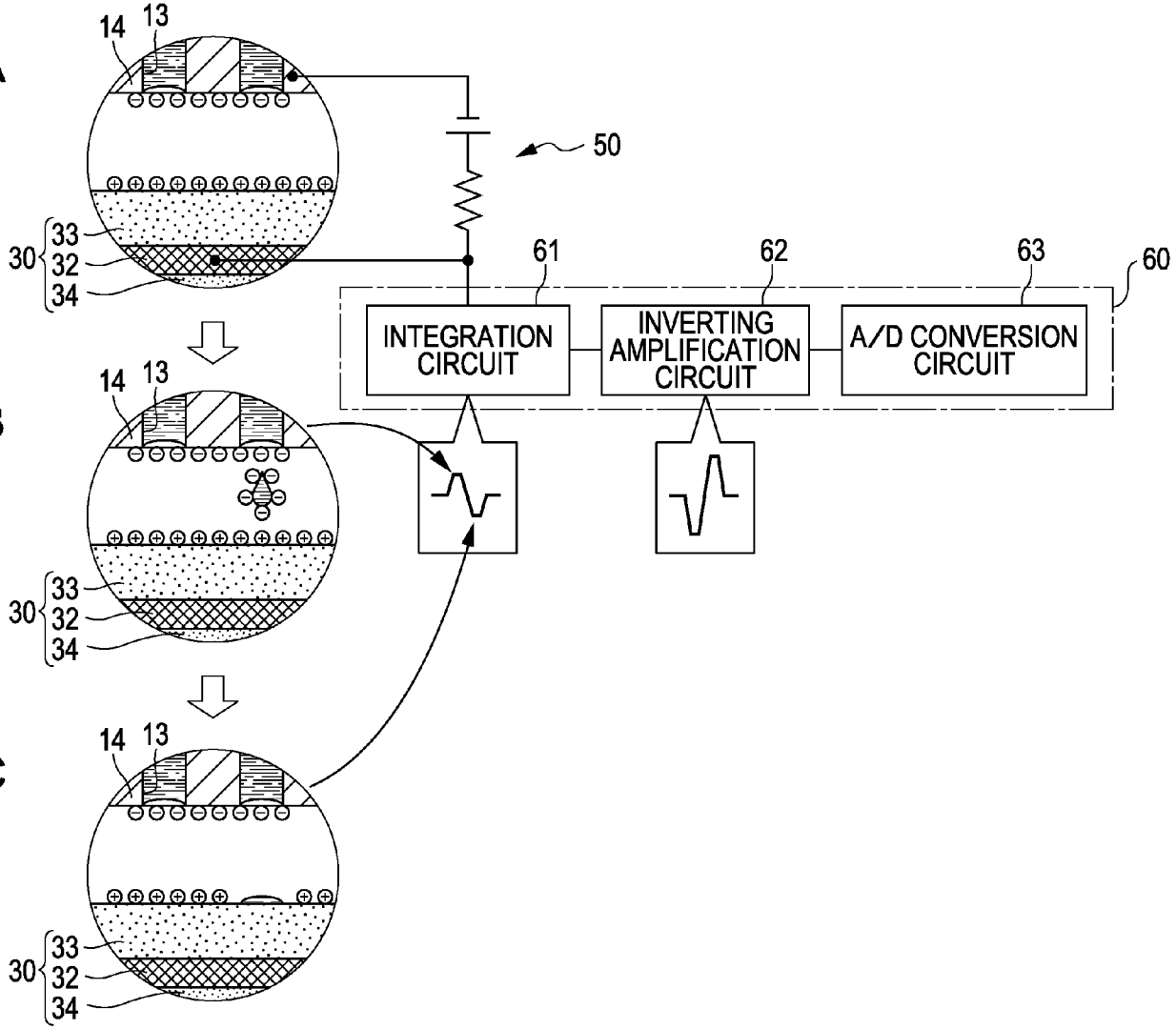
FIGS. 7A, 7B, and 7C are a set of diagrams that schematically illustrates a principle of the generation of an induced voltage due to electrostatic induction.

Next, with reference to FIG. 7, a change in voltage at the electrode member 32 in a usual inspection of a liquid ejecting head inspection apparatus is explained. The voltage change explained below occurs when an electrically charged ink droplet that has been discharged (i.e., ejected) from the nozzle hole 13 of the ink-jet recording head 10 moves in the air to reach the absorbing portion 33 of the liquid droplet landing portion 30. FIGS. 7A, 7B, and 7C are a set of diagrams that schematically illustrates a principle of the generation of an induced voltage due to electrostatic induction. As illustrated in FIG. 7A, ink ("ink droplet") that has not been discharged from the nozzle hole 13 of the ink-jet recording head 10 yet is negatively charged by the voltage application circuit 50. The ink-jet recording head 10 and the absorbing portion 33 are distanced from each other. In addition, there is a predetermined potential difference between the ink-jet recording head 10 and the absorbing portion 33. For this reason, an electric field having predetermined intensity (=potential difference/distance) is generated between the ink-jet recording head 10 and the absorbing portion 33. Therefore, as illustrated in FIG. 7B, as an ink droplet that is negatively charged moves from the nozzle hole 13 toward the absorbing portion 33, positive charge increases on the surface of the absorbing portion 33 due to electrostatic induction. Consequently, the level of a voltage between the ink-jet recording head 10 and the electrode member 32 becomes higher than an original voltage value because of an induced voltage that is generated due to electrostatic induction. Thereafter, when the ink droplet that is negatively charged reaches the absorbing portion 33, the negative charge of the ink droplet neutralizes the positive charge of the absorbing portion 33 as illustrated in FIG. 7C. As a result of neutralization, the voltage level between the ink-jet recording head 10 and the electrode member 32 becomes lower than the original voltage value. Thereafter, the voltage level between the ink-jet recording head 10 and the electrode member 32 returns to the value of the voltage applied therebetween. The amplitude of an output signal depends on the presence/absence of an ink droplet that is discharged from the ink-jet recording head 10 and moves in the air to the absorbing portion 33 and its size as well as the distance from the ink-jet recording head 10 to the absorbing portion 33. For this reason, in a case where no ink droplet "flies" due to the clogging of the nozzle hole 13 or in a case where the size of an ink droplet is smaller than a predetermined size, the amplitude of an output signal is less than that under normal discharging conditions. Therefore, it is possible to judge whether the nozzle hole 13 is clogged or not on the basis of the amplitude of an output signal. The amplitude of an output signal that can be obtained from a single shot of an ink droplet is very small even when the size of the ink droplet is larger than a predetermined size. Therefore, in the present embodiment of the invention, a discharging drive pulse that has the above discharging drive waveform is applied twenty-four times to discharge twenty-four shots of ink droplets. Therefore, an output signal whose amplitude is an integrated value of twenty-four shots of ink droplets can be obtained. In addition, the signal is amplified at the inverting amplification circuit 62. Therefore, the voltage detection circuit 60 can output a waveform having sufficiently large amplitude. Note that the amplitude of a signal outputted from the voltage detection circuit 60 is inverted because it has gone through the inverting amplification circuit 62.

After the discharging of ink droplets from one nozzle hole 13, a signal outputted from the voltage detection circuit 60 is supplied to the judgment unit 70 and the printer controller 111. The control unit 116 of the printer controller 111 judges whether or not the amplitude of a signal outputted from the voltage detection circuit 60, that is, the output level of the voltage detection circuit 60, is greater than or at least equal to a threshold value. The threshold value is an empirically derived value that is set in such a way as to ensure that the output level will exceed the threshold value or will be equal to the threshold value in a case where twenty-four shots of ink droplets are properly discharged, whereas the output level will not exceed the threshold value even when affected by noise or the like in a case where twenty-four shots of ink droplets are not properly discharged. The control unit 116 of the printer controller 111 judges that the nozzle hole 13 that is the current target of judgment is under abnormal conditions such as in a clogged state in a case where the output level is less than the threshold level. In this case, the control unit 116 stores information for identifying this nozzle hole 13 (e.g., information that represents the ordinal number of this nozzle hole in the nozzle line) into a predetermined memory area of the RAM 114. If the output level is greater than or equal to the threshold level, the control unit 116 judges that the nozzle hole 13 that is the current target of judgment is a properly functioning nozzle that is under normal conditions, which means that it is free from clogging or the like.

In addition, the judgment unit 70 judges whether or not the amplitude of the signal outputted from the voltage detection circuit 60, that is, the output level thereof, is greater than or at least equal to a malfunction threshold value of the liquid ejecting head inspection apparatus 40. Herein, the malfunction threshold value is a value that is set in such a way as to ensure that the output level will exceed this threshold value or will be equal to this threshold value if the liquid ejecting head inspection apparatus 40 is in a malfunctioning state when the piezoelectric element 18 is driven by means of a driving signal for discharging twenty-four shots of ink droplets in a non-landing state. The non-landing state is a state in which no ink droplet lands on or into the liquid droplet landing portion 30. The malfunction threshold value is set in such a way as to ensure that the output level will not exceed this threshold value if the liquid ejecting head inspection apparatus 40 is functioning properly.

In a case where the output level is greater than or equal to the malfunction threshold level, the judgment unit 70 judges that the liquid ejecting head inspection apparatus 40 is in a malfunctioning state, that is, in a state in which it cannot correctly inspect whether ink droplets land or not due to the effects of noise on a discharging drive signal or the like. In a case where the output level is less than the malfunction threshold level, the judgment unit 70 judges that the liquid ejecting head inspection apparatus 40 is in a properly functioning state, that is, in a state in which it can correctly inspect whether ink droplets land or not substantially free from the effects of noise on a discharging drive signal or the like.

That is, the judgment unit 70 judges that the liquid ejecting head inspection apparatus 40 is in a malfunctioning state if it is mistakenly detected due to the effects of noise on a discharging drive signal or the like as if some ink droplets landed on or into the liquid droplet landing portion 30 on the basis of the output of the voltage detection circuit 60 (an electric change detecting section) despite the fact that no ink droplet can land on or into the liquid droplet landing portion 30 because of the functioning of a non-landing section according to an aspect of the invention.

Figure 8:
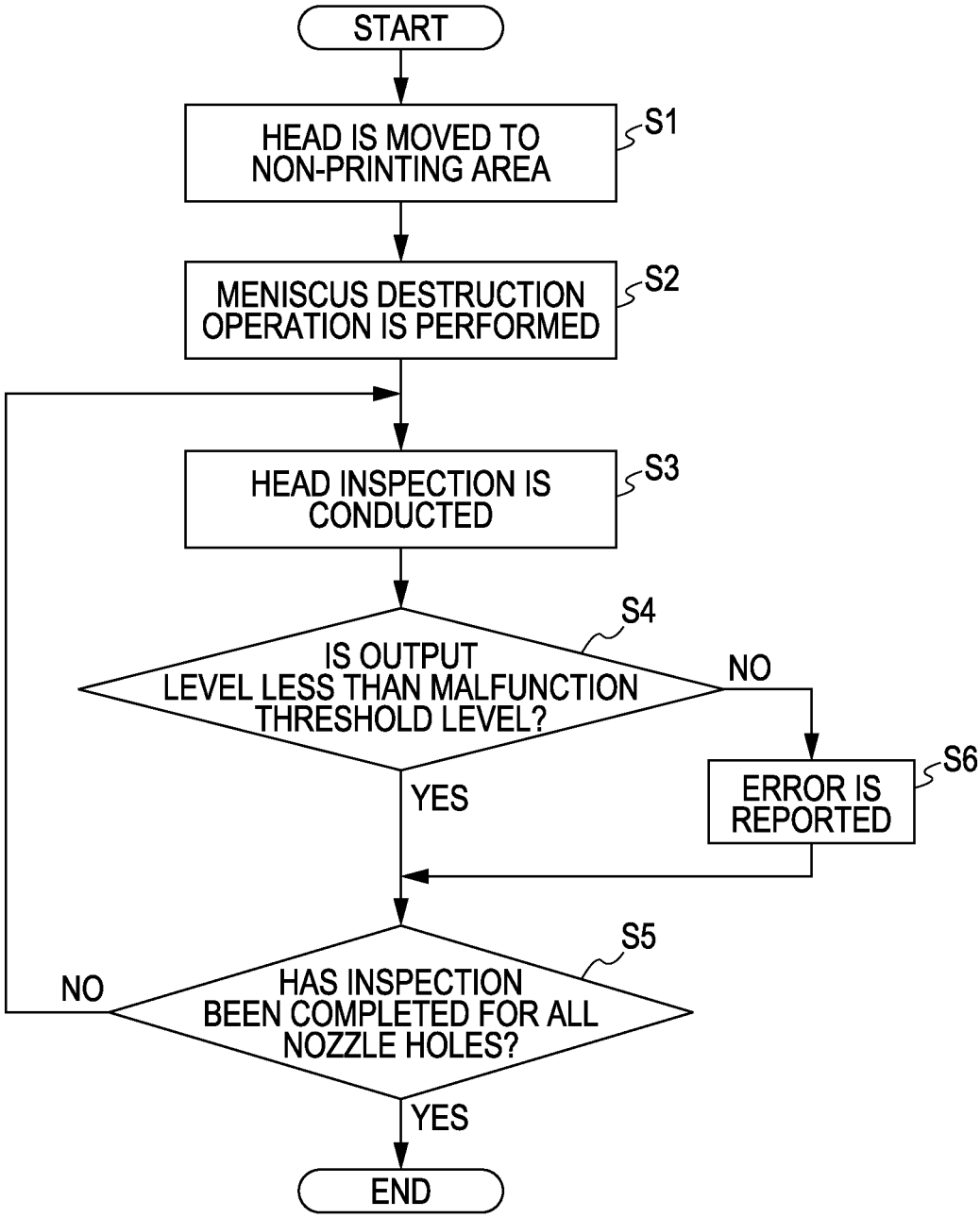
FIG. 8 is a flowchart that schematically illustrates an example of an inspection method according to the first embodiment of the invention.

Next, a fault inspection method for testing whether the liquid ejecting head inspection apparatus 40 is functioning properly or not is explained in detail. FIG. 8 is a flowchart that schematically illustrates an example of a method for testing a liquid ejecting head inspection apparatus according to an exemplary embodiment of the invention.

In a first step S1, the printer controller 111 controls the carriage mechanism 125 to move the ink-jet recording head 10 (carriage 3) to a non-printing area. This operation is the same as that of usual missing-dot detection. At the non-printing area, the ink-jet recording head 10 and the liquid droplet landing portion 30 face each other.

Next, in a step S2, meniscus destruction operation is performed so that the meniscus of the nozzle hole 13 collapses. Specifically, as explained above, the printer controller 111 supplies a destructing drive signal to the piezoelectric element 18 and causes the piezoelectric element 18 to perform piezoelectric operation (i.e., destructing operation) for collapsing ink meniscus at the nozzle hole 13.

Next, in a step S3, usual inspection of the ink-jet recording head 10 is conducted. Specifically, with a predetermined potential difference being generated between the ink-jet recording head 10 (an ink droplet that is to be discharged) and the electrode member 32, the printer controller 111 supplies a discharging drive signal to the piezoelectric element 18 that corresponds to the nozzle hole 13 that is the current target of inspection and causes this piezoelectric element 18 to perform discharging drive operation. Since the meniscus of the nozzle hole 13 has been collapsed in the preceding step S2, no ink droplet actually lands on or into the liquid droplet landing portion 30.

Next, in a step S4, the judgment unit 70 acquires the output level of the voltage detection circuit 60 and judges whether the output level is less than the malfunction threshold level or not. If it is judged that the output level is less than the malfunction threshold level (step S4: YES), it is judged in a step S5 whether inspection has been completed for all of the nozzle holes 13 or not. The series of operations in the steps S3, S4, and S5 is repeated until the completion of inspection for all of the nozzle holes 13. If it is judged that the output level is greater than or equal to the malfunction threshold level (step S4: YES), an error is reported in a step S6. Then, it is judged in the step S5 whether inspection has been completed for all of the nozzle holes 13 or not. For example, an error message or the like may be displayed on a display screen as the error report in the step S6. Or, beep tones or the like may be used to report the error. The reporting of an error shows that the voltage detection circuit 60 picked up noise on a discharging drive signal or the like to output a signal whose level mistakenly indicates as if some ink droplets landed on or into the liquid droplet landing portion 30 when there is no ink droplet that actually lands on or into the liquid droplet landing portion 30. The likely cause of noise effects or the like is defective wiring in a circuit, poor shielding of wiring (noise source), or the like, which can be troubleshot by overhauling the ink-jet recording apparatus I, the liquid ejecting head inspection apparatus 40, or the like, by replacing the defective the liquid ejecting head inspection apparatus 40 with new one, or by other means.

In the present embodiment of the invention, fault inspection for testing whether the liquid ejecting head inspection apparatus 40 is functioning properly or not is conducted for all of the nozzle holes 13. By this means, it is possible to increase the reliability of judgment on the malfunction of the liquid ejecting head inspection apparatus 40. Needless to say, the scope of the invention is not limited to such an example. The fault inspection of the liquid ejecting head inspection apparatus 40 may be conducted for, for example, one or more nozzle holes that are selected arbitrarily.

In the present embodiment of the invention, it is explained that the meniscus of ink (liquid) is collapsed so that no ink droplet can be discharged from the nozzle hole 13. After such meniscus destruction operation, meniscus may be restored. For example, meniscus restoration operation may be performed as follows. A cap member is brought into contact with the ink-jet recording head 10 to cover the nozzle holes 13. A suction device applies a suction force to the cap member. As a result, the internal pressure of the cap member is rendered negative. Ink is sucked out of the ink-jet recording head 10 due to the negative pressure. Or, the piezoelectric element 18, which is an example of a driving element, may be driven for restoring meniscus. Needless to say, other methods may be used for restoring meniscus.

As explained above, the liquid ejecting head inspection apparatus 40 according to the present embodiment of the invention offers the following advantages. The fault inspection of the liquid ejecting head inspection apparatus 40 can be conducted by applying, to the piezoelectric element 18, the same discharging drive signal as that used for inspecting the presence/absence of an ink droplet that is discharged. Therefore, it is possible to check the effects of noise or the like in the same environment as the environment in which the inspection on the presence/absence of an ink droplet discharged is conducted. By this means, it is possible to check whether the inspection on the presence/absence of an ink droplet discharged is conducted correctly or not. That is, it is possible to conduct the fault inspection of the liquid ejecting head inspection apparatus 40 correctly.

In the present embodiment of the invention, the printer controller 111 is used as a non-landing section (non-discharging section) according to an aspect of the invention, which ensures that no liquid droplet lands on or into the liquid droplet landing portion 30, for collapsing meniscus at the nozzle hole 13. Such a configuration is advantageous in that the number of parts that make up the liquid ejecting head inspection apparatus 40 does not increase, which contributes to cost reduction.

The non-landing section according to the present embodiment of the invention collapses meniscus at the nozzle hole 13 by means of a destructing drive signal. Therefore, it is possible to selectively drive not all but some of the piezoelectric elements 18 that correspond to arbitrarily selected nozzle holes 13 by applying the destructing drive signal thereto. In this way, it is possible to collapse meniscus at the arbitrarily selected nozzle holes 13 only. By this means, the fault inspection of the liquid ejecting head inspection apparatus 40 can be conducted in a state in which the discharging of ink droplets from the selected nozzle holes 13 is disabled.

Second Embodiment

Figure 9:
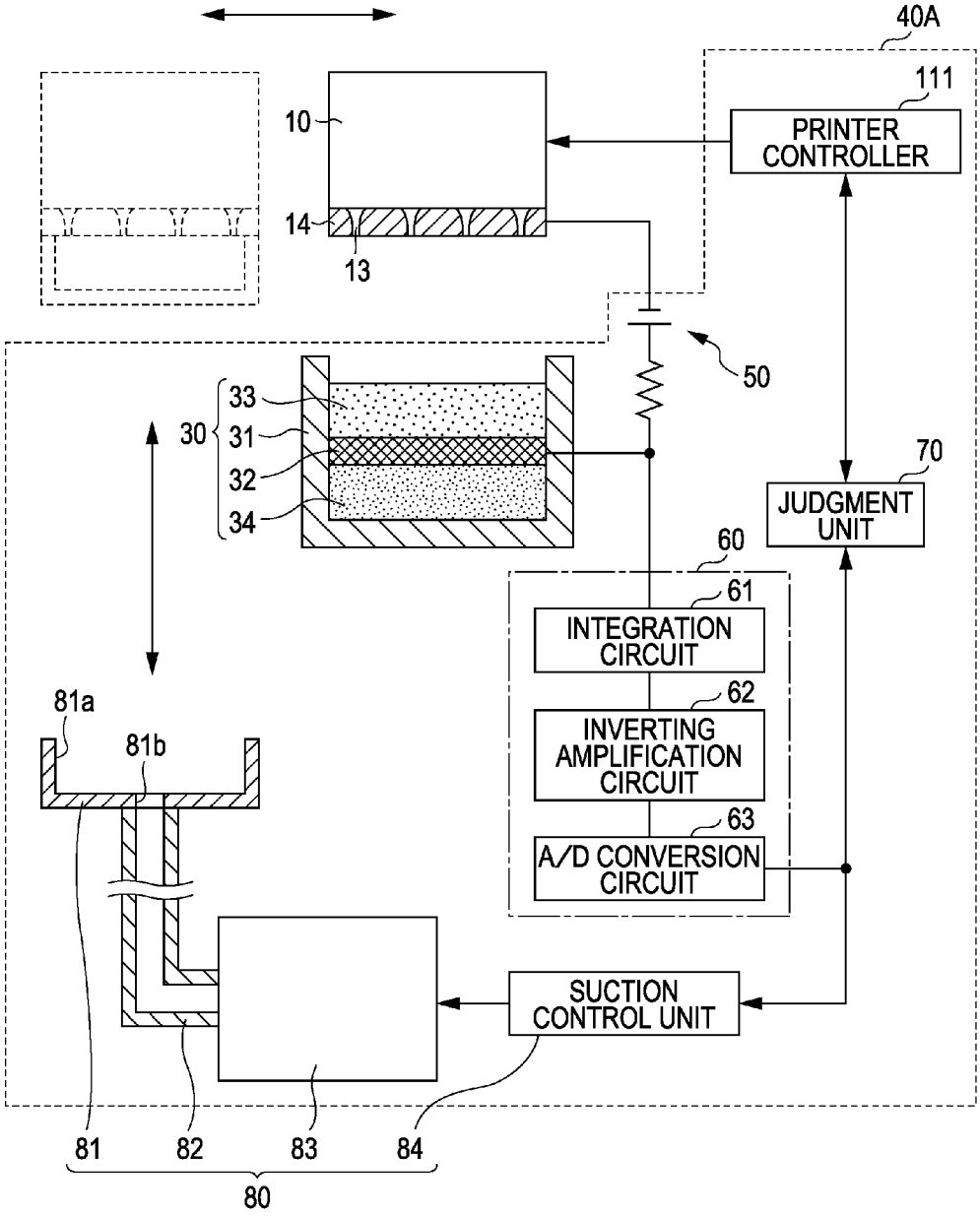
FIG. 9 is a diagram that schematically illustrates an example of the configuration of a liquid ejecting head inspection apparatus according to a second embodiment of the invention.

FIG. 9 is a diagram that schematically illustrates an example of the configuration of a liquid ejecting head inspection apparatus according to a second embodiment of the invention. In the following description of a liquid ejecting head inspection apparatus according to the second embodiment of the invention, the same reference numerals are consistently used for the same components as those of the liquid ejecting head inspection apparatus according to the first embodiment of the invention so as to omit any redundant explanation or simplify explanation thereof.

As illustrated in FIG. 9, a liquid ejecting head inspection apparatus 40A according to the present embodiment of the invention includes the printer controller 111, the liquid droplet landing portion 30, the voltage application circuit 50, the voltage detection circuit 60, the judgment unit 70, and a suction mechanism (suction means) 80.

A non-landing section according to the present embodiment of the invention, which ensures that no liquid droplet (e.g., ink droplet) lands on or into the liquid droplet landing portion 30, includes the suction mechanism 80. The non-landing section according to the present embodiment of the invention is a non-discharging section that ensures that no liquid droplet is discharged from the nozzle hole 13.

The suction mechanism 80 includes a cap member 81, a tube 82, a suction device 83, and a suction control unit 84. The cap member 81 is a member that can be brought into contact with the edges of a liquid ejecting face through which the nozzle holes 13 are formed. The suction device 83 is connected to the cap member 81 through the tube 82. An example of the suction device 83 is a vacuum pump. The suction control unit 84 controls the suction device 83.

The cap member 81 is provided opposite to the nozzle plate 14 of the ink-jet recording head 10. The cap member 81 can move toward and away from the ink-jet recording head 10.

The cap member 81 can cover all of nozzle holes 13 without being in contact therewith. The cap member 81 has a suction opening portion 81*a*. The suction opening portion 81*a* is formed opposite to the nozzle plate 14 at an area in a plan view that is wider than the entire area of the nozzle holes 13; that is, the suction opening portion 81*a* is formed throughout all of the nozzle holes 13. When the frame edges of the suction opening portion 81*a* are in contact with the surface of the nozzle plate 14, the cap member 81 covers all of the nozzle holes 13. The cap member 81 has a communication port 81*b*. The communication port 81*b* is formed in communication with the suction opening portion 81*a* at a side opposite to the open side, which is the suction-opening-portion side. The tube 82 through which the suction device 83 is in communication with the cap member 81 is connected to the communication port 81*b*.

The suction control unit 84 performs suction control in such a way as to cause the suction device 83 to perform suction operation at predetermined timing. In addition, the suction control unit 84 controls the elevation movement of the cap member 81, specifically, the movement of the cap member 81 toward the ink-jet recording head 10, thereby controlling timing for covering the nozzle holes 13 by the cap member 81.

As illustrated in FIG. 1 referred to in the foregoing explanation of the first embodiment of the invention, the suction mechanism 80 having the above configuration is provided at the other non-printing area, which is located at the side opposite the liquid droplet landing portion side. This means that the printing area is located between one non-printing area at which the liquid droplet landing portion 30 is provided and the other non-printing area at which the suction mechanism 80 is provided.

The frame edges of the suction opening portion 81*a* of the cap member 81 are brought into contact with the surface of the nozzle plate 14. In such a capped state, the suction control unit 84 causes the suction device 83 to perform suction operation. As a result, the internal pressure of the cap member 81 becomes negative. Due to the negative pressure inside the cap member 81, ink that is retained in inner fluid channels including the pressure generation chambers 12 is sucked out through the nozzle holes 13. The cap member 81 has another function of preventing the viscosity of ink that is retained near the nozzle holes 13 from increasing due to drying thereof. To avoid ink from becoming thickened, the cap member 81 covers the nozzle holes 13 not only during suction operation but also at some timing other than suction operation, for example, when power is OFF, during standby, periodically, or the like.

Figure 10:
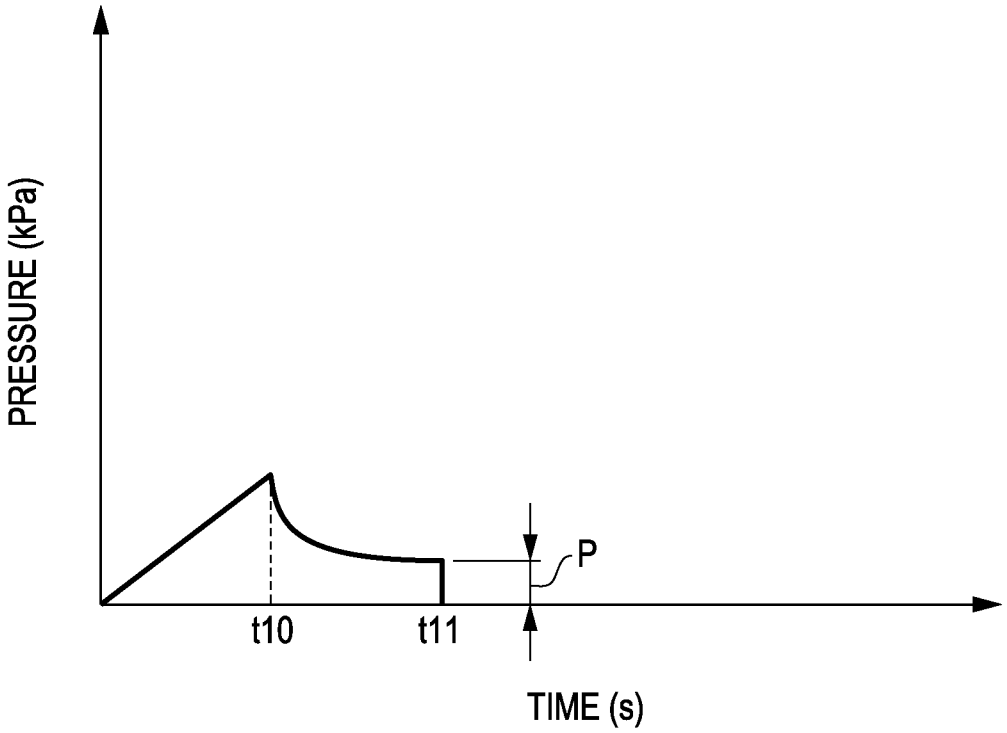
FIG. 10 is a graph that shows an example of pressure of a suction device according to the second embodiment of the invention.

In the present embodiment of the invention, the suction mechanism 80 functions as a non-landing section (non-discharging section) according to an aspect of the invention, which ensures that no liquid droplet lands on or into the liquid droplet landing portion 30. Specifically, in response to a command for conducting the fault inspection of the liquid ejecting head inspection apparatus 40A, which is issued by the printer controller 111 (refer to FIG. 4, which is a drawing that illustrates the first embodiment of the invention), the suction control unit 84 stops the operation of the suction device 83 at a point in time earlier than that in usual suction operation. The timing of suction operation performed by the suction mechanism 80 is explained below. FIG. 10 is a graph that shows an example of a relationship between the internal pressure of a cap member and suction time according to the second embodiment of the invention.

As illustrated in FIG. 10, the suction device 83 starts suction operation in a state in which the cap member 81 covers all of the nozzle holes 13. The internal pressure of the cap member 81 increases gradually as time passes. Then, the suction device 83 stops suction operation at a point in time t10. Accordingly, the internal pressure of the cap member 81 decreases gradually. Thereafter, at a point in time t11, the cap member 81 is moved away from the ink-jet recording head 10 to open the inner space of the cap member 81 to the outside air. As a result, the internal pressure of the cap member 81 becomes equal to atmospheric pressure. A difference between the internal pressure of the cap member 81 before opening to the outside air and atmospheric pressure varies depending on the point in time t11 (timing) at which the cap member 81 is moved away from the ink-jet recording head 10 to open the inner space of the cap member 81 to the outside air. The pressure difference is denoted as P. The suction control unit 84 according to the present embodiment of the invention sets the timing of opening the inner space of the cap member 81 to the outside air at a point in time earlier than air-opening timing in usual cleaning operation (i.e., operation performed for removing air bubbles, foreign objects, and the like). With such timing control, the suction control unit 84 ensures that the pressure difference P is sufficiently large.

When the pressure difference P, which is a difference between pressure before the opening of the inner space of the cap member 81 to the outside air and after the opening thereof to the outside air, is large, ink meniscus at the nozzle hole 13 collapses. Specifically, when the pressure difference P is large, meniscus sucked toward the cap member 81 returns rapidly toward the pressure generation chamber 12 as a reaction to the opening of the inner space of the cap member 81 to the outside air, which results in a state in which the meniscus has receded toward the pressure generation chamber 12. Even when the same discharging drive signal as that of the first embodiment of the invention is applied to the piezoelectric element 18 to drive the piezoelectric element 18 in the above meniscus state, no ink droplet is discharged from the nozzle hole 13.

The fault inspection method of the liquid ejecting head inspection apparatus 40A according to the second embodiment of the invention in which the suction mechanism 80 functions as a non-landing section (non-discharging section) is substantially the same as the fault inspection method of the liquid ejecting head inspection apparatus 40 according to the first embodiment of the invention.

Third Embodiment

Figure 11:
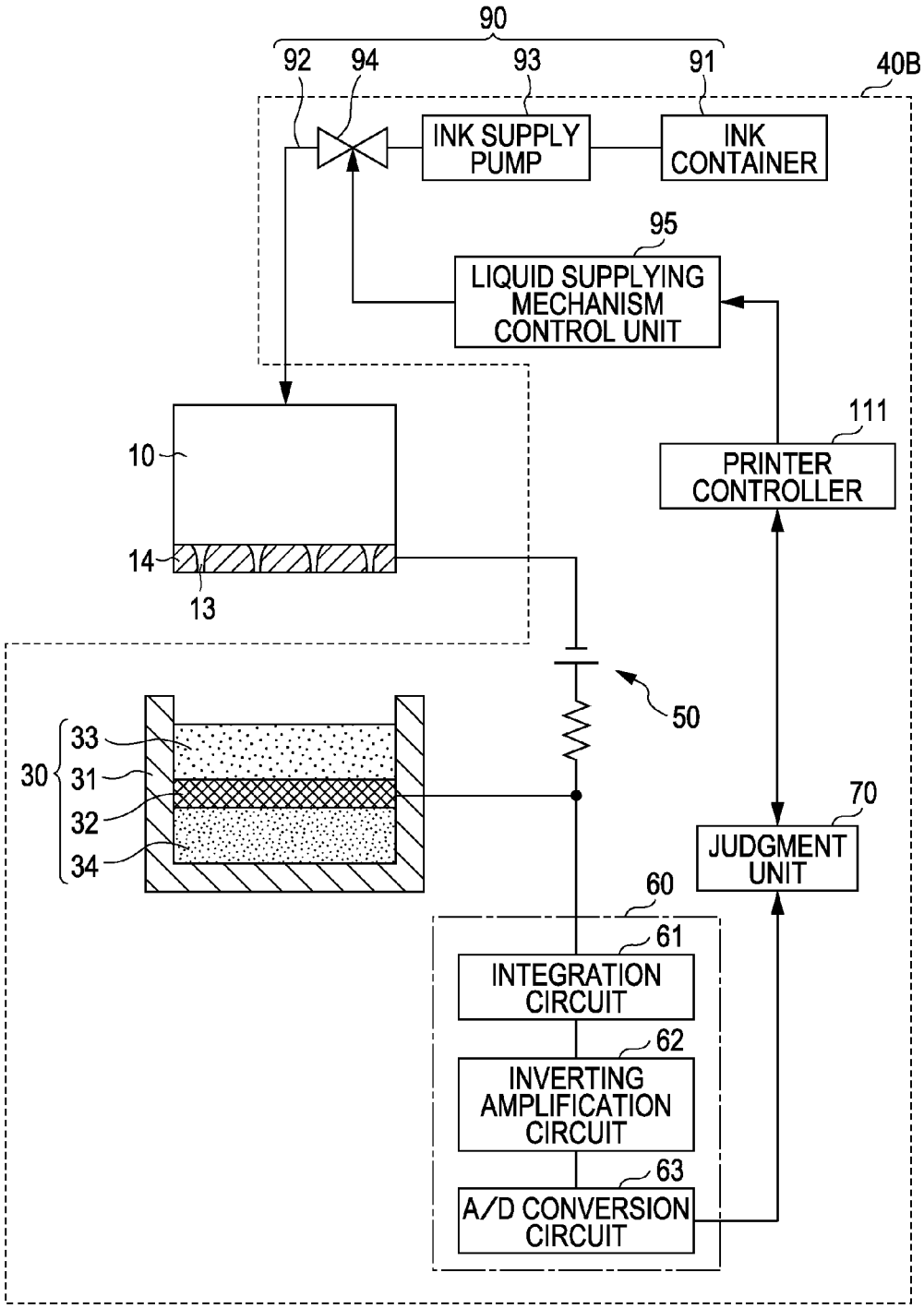
FIG. 11 is a diagram that schematically illustrates an example of the configuration of a liquid ejecting head inspection apparatus according to a third embodiment of the invention.

FIG. 11 is a diagram that schematically illustrates an example of the configuration of a liquid ejecting head inspection apparatus according to a third embodiment of the invention. In the following description of a liquid ejecting head inspection apparatus according to the third embodiment of the invention, the same reference numerals are consistently used for the same components as those of the liquid ejecting head inspection apparatus according to the foregoing embodiment of the invention so as to omit any redundant explanation or simplify explanation thereof.

As illustrated in FIG. 11, a liquid ejecting head inspection apparatus 40B according to the present embodiment of the invention includes the printer controller 111, the liquid droplet landing portion 30, the voltage application circuit 50, the voltage detection circuit 60, the judgment unit 70, a liquid supplying mechanism (liquid supplying means) 90, and a liquid supplying mechanism control unit 95.

A non-landing section according to the present embodiment of the invention, which ensures that no liquid droplet (e.g., ink droplet) lands on or into the liquid droplet landing portion 30, includes the liquid supplying mechanism 90 and the liquid supplying mechanism control unit 95. The non-landing section according to the present embodiment of the invention is a non-discharging section that ensures that no liquid droplet is discharged from the nozzle hole 13.

The liquid supplying mechanism 90 includes an ink container 91, an ink supply tube 92, an ink supply pump 93, and a valve unit 94. The ink container 91, which contains ink, is connected to the ink-jet recording head 10 through the ink supply tube 92. The ink supply pump 93 is provided at an intermediate position on the ink supply tube 92. The ink supply pump 93 performs pumping operation to supply ink that is contained in the ink container 91 to the ink-jet recording head 10. The valve unit 94 is provided between the ink supply pump 93 and the ink-jet recording head 10. The valve unit 94 opens or closes the ink supply tube 92.

The liquid supplying mechanism control unit 95 controls the valve unit 94 to open or close the valve. The liquid supplying mechanism control unit 95 stops the supplying of ink to the ink-jet recording head 10 at predetermined timing by controlling the valve unit 94.

Specifically, the liquid supplying mechanism control unit 95 performs control to stop the supplying of ink to the ink-jet recording head 10 at timing specified by a command for conducting the fault inspection of the liquid ejecting head inspection apparatus 40B, which is issued by the printer controller 111 (refer to FIG. 4, which is a drawing that illustrates the first embodiment of the invention). That is, the liquid supplying mechanism control unit 95 performs control to ensure that no ink is supplied into the pressure generation chamber 12 when a discharging drive signal is applied to the piezoelectric element 18. Since the supplying of ink into the pressure generation chamber 12 is stopped, no ink droplet is discharged from the nozzle hole 13 even when the piezoelectric element 18 is driven by means of a discharging drive signal. Therefore, it is possible to conduct the fault inspection of the liquid ejecting head inspection apparatus 40B according to the third embodiment of the invention with substantially the same advantages as the fault inspection of the liquid ejecting head inspection apparatus 40 according to the first embodiment of the invention easily and reliably.

Other Embodiments

Although exemplary embodiments of the invention are explained above, needless to say, the basic configuration and the scope of the invention are not limited to any of the foregoing specific embodiments and examples. For example, the judgment unit 70 may make a malfunction judgment within a predetermined period of time after the application of a discharging drive signal to the piezoelectric element 18. By this means, it is possible to perform malfunction judgment processing accurately while suppressing or avoiding erroneous detection due to the effects of noise from the outside of the ink-jet recording apparatus I.

In the foregoing first, second, and third embodiments of the invention, it is explained that the longitudinal vibration type piezoelectric element 18 is used as a driving element. However, the scope of the invention is not limited to such an exemplary configuration. For example, a thin film deflection vibration type piezoelectric element may be used. The thin film deflection vibration type piezoelectric element may be configured as a lamination of a lower electrode, a piezoelectric substance layer, and an upper electrode. Or, a thick film deflection vibration type piezoelectric element may be used. The thick film deflection vibration type piezoelectric element may be formed by a green sheet adhesion method. As another modification example thereof, the driving element may be embodied as a thermal discharging actuator device. In the thermal discharging configuration, a heating element or the like that is provided in the pressure generation chamber 12 generates heat. The thermal discharging actuator device discharges liquid droplets (e.g., ink droplets) from its nozzle holes by utilizing bubbles formed as a result of heat generation. As still another modification example thereof, the driving element may be embodied as a so-called electrostatic actuator device. In the electrostatic configuration, static electricity is generated between a vibrating plate and electrodes. Then, electrostatic force is utilized to deflect the vibrating plate so as to discharge liquid droplets from nozzle holes.

The invention is directed to a liquid ejecting head inspection apparatus for various kinds of liquid ejecting heads. Liquid ejecting heads to which a liquid ejecting head inspection apparatus according to some aspects of the invention is applicable encompass a wide variety of heads; specifically, they include without any limitation thereto: a variety of recording heads inclusive of ink-jet recording heads that are used in an image recording apparatus such as a printer or the like, a color material ejection head that is used in the production of color filters for a liquid crystal display device or the like, an electrode material (i.e., conductive paste) ejection head that is used for the electrode formation of an organic EL display device or a surface/plane emission display device (FED, field emission display) and the like, a living organic material ejection head that is used for production of biochips.

In the foregoing first, second, and third embodiments of the invention, the ink-jet recording apparatus I is taken as an example of a liquid ejecting apparatus. Notwithstanding the foregoing, however, the invention can be applied to various liquid ejecting apparatuses equipped with various liquid ejecting head inspection apparatuses for various liquid ejecting heads, examples of which are described above.

What is claimed is:

1. A liquid ejecting head inspection apparatus for detecting malfunction of a liquid ejecting head that discharges a liquid droplet from a nozzle opening as a result of driving operation of a driving element, the liquid ejecting head inspection apparatus comprising:

a liquid droplet landing portion on or into which a liquid droplet discharged by the liquid ejecting head can land;

an electric change detecting section that detects an electric change in the liquid droplet landing portion;

a controlling section that performs control to supply a discharging drive signal for discharging a liquid droplet to the driving element, to generate a potential difference between the liquid droplet discharged by the liquid ejecting head and the liquid droplet landing portion, and to detect landing of the liquid droplet on the basis of a result of detection of the electric change detecting section when the electrically charged liquid droplet is ejected toward the liquid droplet landing portion in a state in which the potential difference is generated between the liquid droplet discharged by the liquid ejecting head and the liquid droplet landing portion;

a non-landing section that ensures that no liquid droplet lands on or into the liquid droplet landing portion when the discharging drive signal is applied to the driving element; and a judging section that judges whether the liquid ejecting head inspection apparatus itself is functioning properly or not on the basis of the result of detection of the electric change detecting section.

2. The liquid ejecting head inspection apparatus according to claim 1, wherein the non-landing section is a non-discharging section that ensures that no liquid droplet is discharged from the nozzle opening even when the driving element is driven by means of the discharging drive signal.

3. The liquid ejecting head inspection apparatus according to claim 2, wherein the non-discharging section supplies a destructing drive signal, which is a signal for disabling liquid ejection by destroying meniscus of liquid at the nozzle opening.

4. The liquid ejecting head inspection apparatus according to claim 2, wherein the non-discharging section includes a cap member that can cap a liquid ejecting face through which the nozzle opening is formed, a suction device that is connected to the cap member, and a suction control unit that controls suction of the suction device and capping of the cap member so as to disable liquid ejection by destroying meniscus of liquid at the nozzle opening.

5. The liquid ejecting head inspection apparatus according to claim 3, further comprising a restoring section that restores meniscus after destruction at the nozzle opening.

6. The liquid ejecting head inspection apparatus according to claim 2, wherein the non-discharging section includes a liquid supplying section that supplies liquid to the liquid ejecting head and stops supplying of the liquid to the liquid ejecting head and further includes a liquid-supplying-section control section that performs control to stop the supplying of the liquid to the liquid ejecting head by the liquid supplying section.

7. The liquid ejecting head inspection apparatus according to claim 1, wherein the controlling section performs control to detect the landing of the liquid droplet on the basis of the result of detection of the electric change detecting section within a predetermined period of time after the discharging of the liquid droplet.

8. A liquid ejecting apparatus that is provided with the liquid ejecting head inspection apparatus according to claim 1.

9. An inspection method of a liquid ejecting head inspection apparatus, a liquid ejecting head discharging a liquid droplet from a nozzle opening as a result of driving operation of a driving element, the liquid droplet discharged by the liquid ejecting head from the nozzle opening landing on or into a liquid droplet landing portion, a potential difference being generated between the liquid droplet discharged from the nozzle opening and the liquid droplet landing portion, an electric change being detected when the liquid droplet lands on or into the liquid droplet landing portion, the landing of the liquid droplet on or into the liquid droplet landing portion being detected on the basis of electric change detection, the inspection method comprising:

causing the driving element to perform driving operation for discharging the liquid droplet from the nozzle opening; and detecting the electric change in the liquid droplet landing portion while ensuring that no liquid droplet lands on or into the liquid droplet landing portion.

* * * * *